US006206080B1

(12) United States Patent
Ji

(10) Patent No.: US 6,206,080 B1
(45) Date of Patent: Mar. 27, 2001

(54) DIE CASTING APPARATUS FOR A ROTOR

(75) Inventor: Yong-Gi Ji, Incheon (KR)

(73) Assignee: Daewoo Electronics Co., Ltd., Seoul (KR)

( * ) Notice: Subject to any disclaimer, the term of this patent is extended or adjusted under 35 U.S.C. 154(b) by 0 days.

(21) Appl. No.: 09/203,347

(22) Filed: Dec. 2, 1998

(30) Foreign Application Priority Data

Mar. 18, 1998 (KR) ..... 98-9345

(51) Int. Cl.[7] ..... B22D 17/24
(52) U.S. Cl. ..... 164/332; 164/333; 164/334
(58) Field of Search ..... 164/109, 332, 164/333, 334

(56) References Cited

U.S. PATENT DOCUMENTS

| | | | |
|---|---|---|---|
| 4,064,928 | 12/1977 | Wunder | 164/264 |
| 4,362,205 | 12/1982 | Cole et al. | 164/109 |
| 5,332,026 | 7/1994 | Thieman et al. | 164/493 |
| 5,538,067 * | 7/1996 | Nakamura et al. | 164/333 |

FOREIGN PATENT DOCUMENTS

| | | | |
|---|---|---|---|
| 2265251 | 3/1977 | (DE) . | |
| 1224100 * | 4/1986 | (SU) | 164/333 |

* cited by examiner

*Primary Examiner*—Harold Pyon
*Assistant Examiner*—I. H. Lin
(74) *Attorney, Agent, or Firm*—Jacobson, Price, Holman & Stern, PLLC

(57) ABSTRACT

An apparatus for die casting a rotor is disclosed, by which the die cast totors do not require reworking processes. An annular inner wall and an annular outer wall of a first mold are projected against an opposite surface of an intermediate die plate facing the movable die plate for inserting the inner wall and the outer wall into a sleeve. An annular first cavity is formed between the inner wall and the outer wall, and a plurality of sprues is penetrated from an upper surface of the first mold to an annular first cavity. A plurality of gates protrude from a bottom portion of the first cabity. Also, sizing bars inject high pressure water through spraying holes to clean the die plates.

8 Claims, 9 Drawing Sheets

DIE CASTING APPARATUS FOR A ROTOR

BACKGROUND OF THE INVENTION

1. Field of the Invention

This invention relates to a method and apparatus for die casting rotor used in a motor, more particularly die casting apparatus for a rotor and method thereof which may eliminate a reworking process such as turning operations and broaching operations, and may simplify a manufacturing process by changing a mold's shape.

2. Prior Art

FIG. 1 is a sectional view partially showing a conventional die casting apparatus.

A conventional die casting apparatus, as shown in FIG. 1, has a stationary die plate 5 and an intermediate die plate 15 at the right side, and a movable die plate 21 and a base die plate 23 at the left side with reference to parting line PL. An extracting plate 10 for extracting the die cast rotor is mounted between the stationary die plate 5 and the intermediate die plate 15.

An insert 4 forming a main passage 3 of molten aluminum is installed in the stationary die plate 5.

A first mold 11 forming an annular first cavity 13 and a plurality of sprues 12 are installed in the intermediate die plate 15. An annular sleeve 31 and a second mold 37 are mounted in the movable die plate 21, and a preform 33 of the rotor is inserted on the second mold 37.

The preform 33 consists of a plurality of circular stacks 34, a central bore 32, and a plurality of circularly arranged openings 35.

A manufacturing process for a rotor using the above-mentioned die casting apparatus will be described below.

The molten aluminum of high temperature and pressure flows from the main passage 3 into an annular first cavity 13 through a plurality of sprues and then into an annular second cavity 39 passing through the openings.

If the molten aluminum is cooled, a die cast rotor is completed.

According to the above-mentioned die casting apparatus, because the molten aluminum is injected into the cavity of the first mold at high pressure, the molten aluminum leaks from the combination part between the first mold and an opposite surface of the movable die plate facing the intermediate die plate. FIG. 2 is a perspective view of a die cast rotor by the conventional die casting apparatus. Referring to the die cast rotor shown in FIG. 2, the leaked molten aluminum is cooled on a upper periphery of the preform 33, which results in forming projections 42.

When the molten aluminum is filled and cooled in the annular first mold 11 and thus the first mold 11 is separated, a small quantity of the molten aluminum is cooled in a projected state along a plurality of sprue gates.

Therefore, a number of projections 45 are formed on an upper surface of the die cast rotor on which the sprue gates have been placed. Furthermore, because the molten aluminum is injected at high temperature and high pressure, an inner diameter of the preform is deformed, thereby concentricity of the die cast rotor may not be uniform. Accordingly, the rotor for a motor which is die cast by conventional die casting apparatus should be reworked by broaching operations and turning operations after die casting operation for precision manufacturing of the inner and outer diameters of the rotor.

THE SUMMARY OF THE INVENTION

To solve the above problems, it is a first object of the present invention to provide a die casting apparatus which can die cast a rotor having precise inner and outer diameters without independent reworking processes such as broaching operations and turning operations after die casting process.

It is a second object of the present invention to provide a die casting apparatus automatically cleaning plates by injecting high pressure water through a plurality of spraying holes of a sizing bar or a locator.

It is a third object of the present invention to provide a method and apparatus for die casting a rotor which simplifies a manufacturing process, and reduces processing time and manufacturing cost.

To obtain these objects, a die casting apparatus for a rotor comprises a stationary die plate mounting an insert in which a main passage of molten metal and a plurality of bores are formed, an extracting plate located on an opposite side of the insert which is able to move into the insert of the stationary die plate along a central axis and extracting metal scrap after die casting completion, an intermediate die plate mounting a plurality of first molds and receiving the extracting plate by moving toward the stationary die plate along the central axis, a movable die plate mounting a plurality of second molds and a plurality of sleeves for loading a preform respectively and moving forward together with the intermediate die plate toward the stationary die plate by pushing in abutment with said intermediate die plate, and a plurality of locators mounted on the stationary die plate by a nut and forming a plurality of spraying holes on each locator for cleaning the plates.

An annular inner wall and an annular outer wall of the first mold are projected against an opposite surface of the intermediate die plate facing the movable die plate for inserting said walls into the sleeve.

An annular first cavity is formed between said inner wall and said outer wall, and a plurality of sprues are penetrated from an upper surface of the first mold to the first cavity.

A plurality of gates are protruded from a bottom portion of the annular first cavity.

BRIEF DESCRIPTION OF THE DRAWINGS

This invention will be better understood and its various objects and advantages will be more fully appreciated from the following description taken in conjunction with the accompanying drawings, in which.

DETAILED DESCRIPTION OF THE PREFERRED EMBODIMENT

Hereinafter, a preferred embodiment according to the present invention will be described in detail with reference to the drawings.

Figure 1:
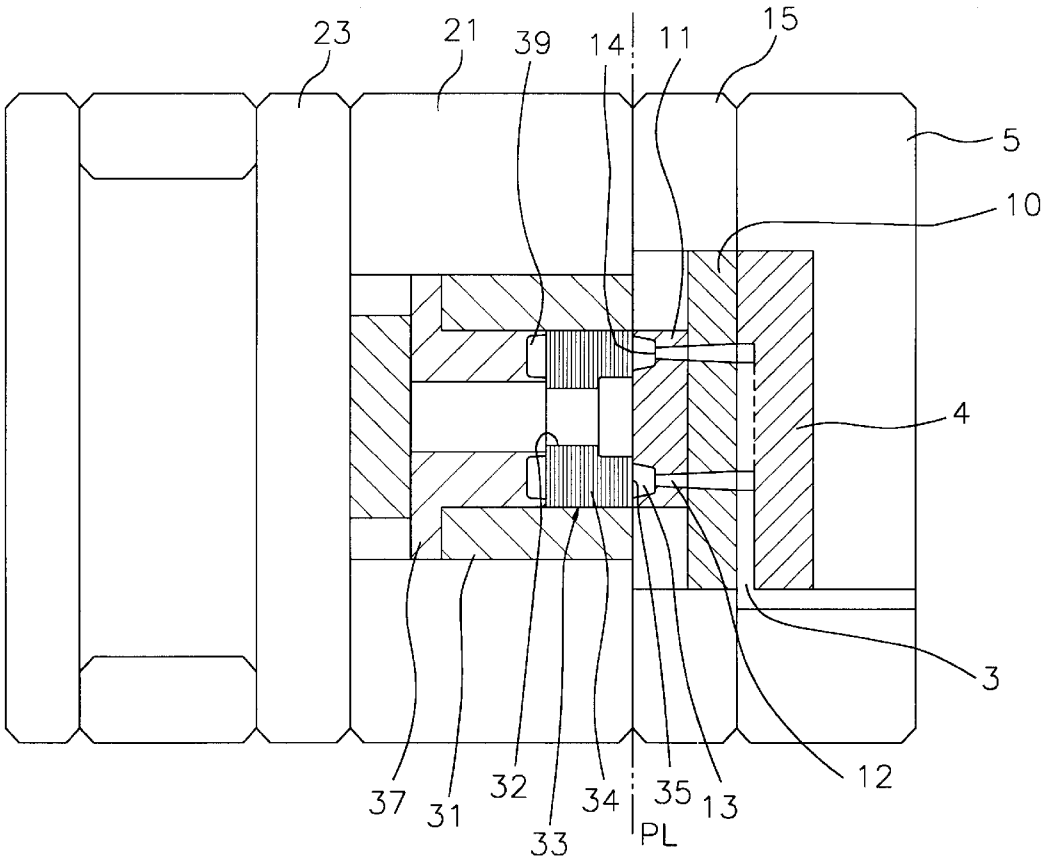
FIG. 1 PRIOR ART
FIG. 1 is a sectional view partially showing a conventional die casting apparatus for a rotor.
Figure 2:
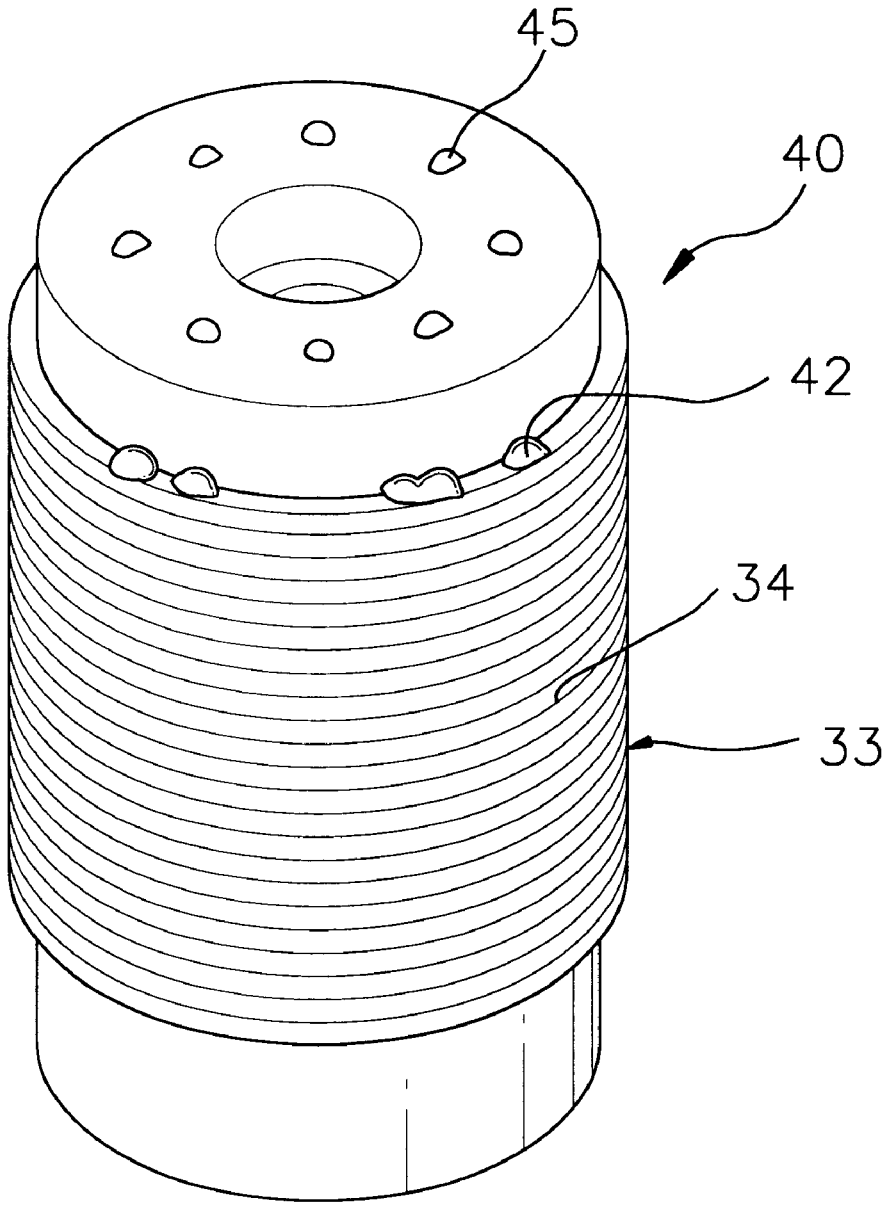
FIG.2 PRIOR ART
FIG. 2 is a perspective view of a die cast rotor by the die casting apparatus shown in FIG. 1.
Figure 3:
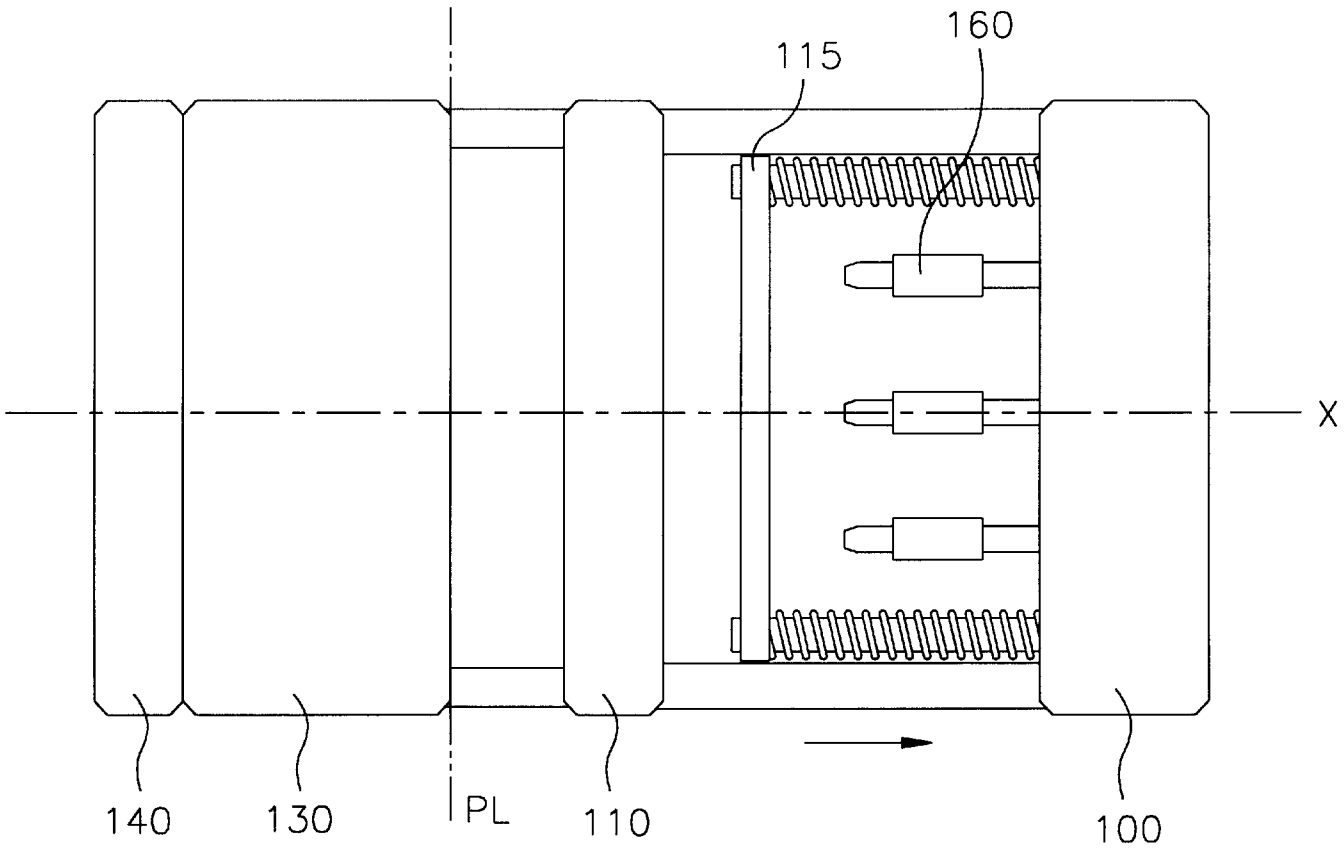
FIG. 3 is a schematic view of a die casting apparatus for a rotor according to a preferred embodiment of the present invention.

FIG. 3 is a schematic view of a die casting apparatus according to the present invention.

A die casting apparatus according to the present invention, as shown in FIG. 3, has a stationary die plate 100, an extracting plate 115, and an intermediate die plate 110 at the right side, and a movable die plate 130 and base die plate 140 at the left side, with reference to parting line PL.

The extracting plate 115 is located between the stationary die plate 100 and the intermediate die plate 110, and the movable die plate 130 is located between the intermediate die plate 110 and the base die plate 140.

The plates are located along a central axis X passing from a center of the stationary die plate 100 to the base die plate 140.

Figure 4:
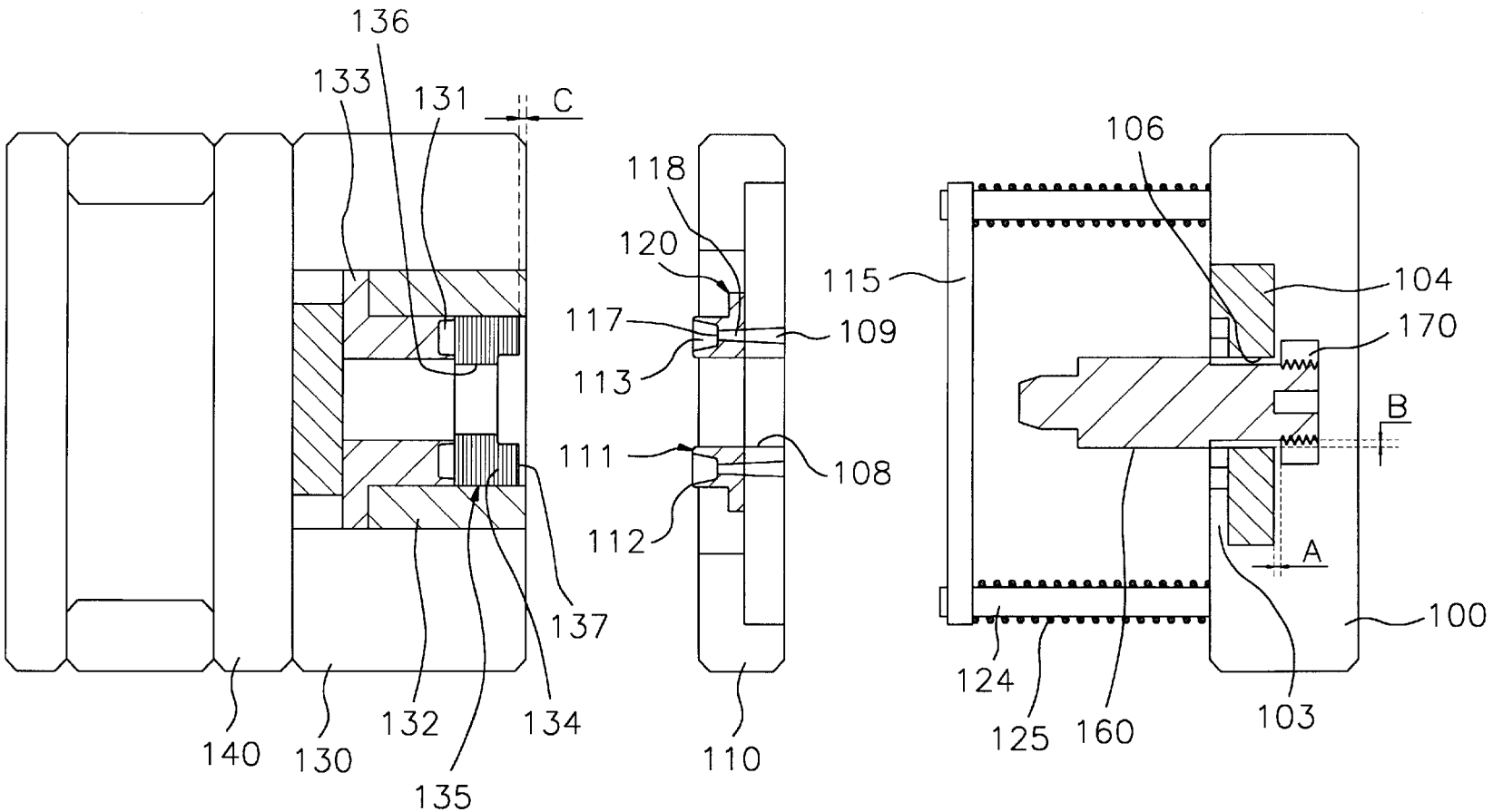
FIG. 4 is a sectional view partially showing one of sleeves and a preform received therein, before the combination of the die casting apparatus shown in FIG. 3.

FIG. 4 is a sectional view partially showing one of sleeves and a preform received therein, before the combination of the die casting apparatus according to the present invention.

As shown in FIG. 4, a preform 135 consists of a plurality of circular stacks 134, a central bore 136, and a plurality of circularly arranged openings 137.

An insert 104 having a main passage 103 of molten metal and a plurality of bores 106 is received in the stationary die plate 100. A plurality of sizing bars or locators 160 passing through the bores 106 of the insert 104 are mounted on the stationary die plate 100 by a nut 170.

A first spaced portion A is formed between the sizing bar 160 and the insert 104 so that the sizing bar 160 can reciprocate in the bore 106 of the insert 104 by a scope of the first spaced portion A, and a second spaced portion B is formed between the sizing bar 160 and the bore 106 of the insert 104 so that the sizing bar 160 can swivel or turn about the nut 170 by the scope of the second spaced portion B.

Because an outer diameter of the sizing bar 160 is similar with an inner diameter of each bore, great pressure is applied to the sizing bar 160 when the sizing bar 160 passes through the bores.

Therefore, if the first spaced portion A and the second spaced portion B are not formed, the sizing bar 160 may break.

The extracting plate 115 is movably placed toward the insert 104 of the stationary die plate 100 along the center axis X, and extracts metal scrap from the intermediate die plate 110 after the completion of die casting.

The intermediate die plate 110 has a first mold 120 at an opposite portion thereof facing the movable die plate 130.

The movable die plate 130 has a sleeve 132 in which the preform 135 is received and a second mold 133 installed in the sleeve 132 inside. The preform 135 is inserted to an end portion of the second mold 133 along an inner wall of the sleeve 132. Also, the preform 135 received in the sleeve 132 is placed off at a predetermined depth C from an opposite surface of the movable die plate 130 facing said intermediate die plate 110.

Furthermore, there are cooling water passages (not shown) installed in the die plates for cooling the molten metal, an actuator (not shown) for moving the movable die plate 130 and the base die plate 140 toward the stationary die plate 100, and a protective cover (not shown) for protecting an operator from die casting operation.

Figure 5:
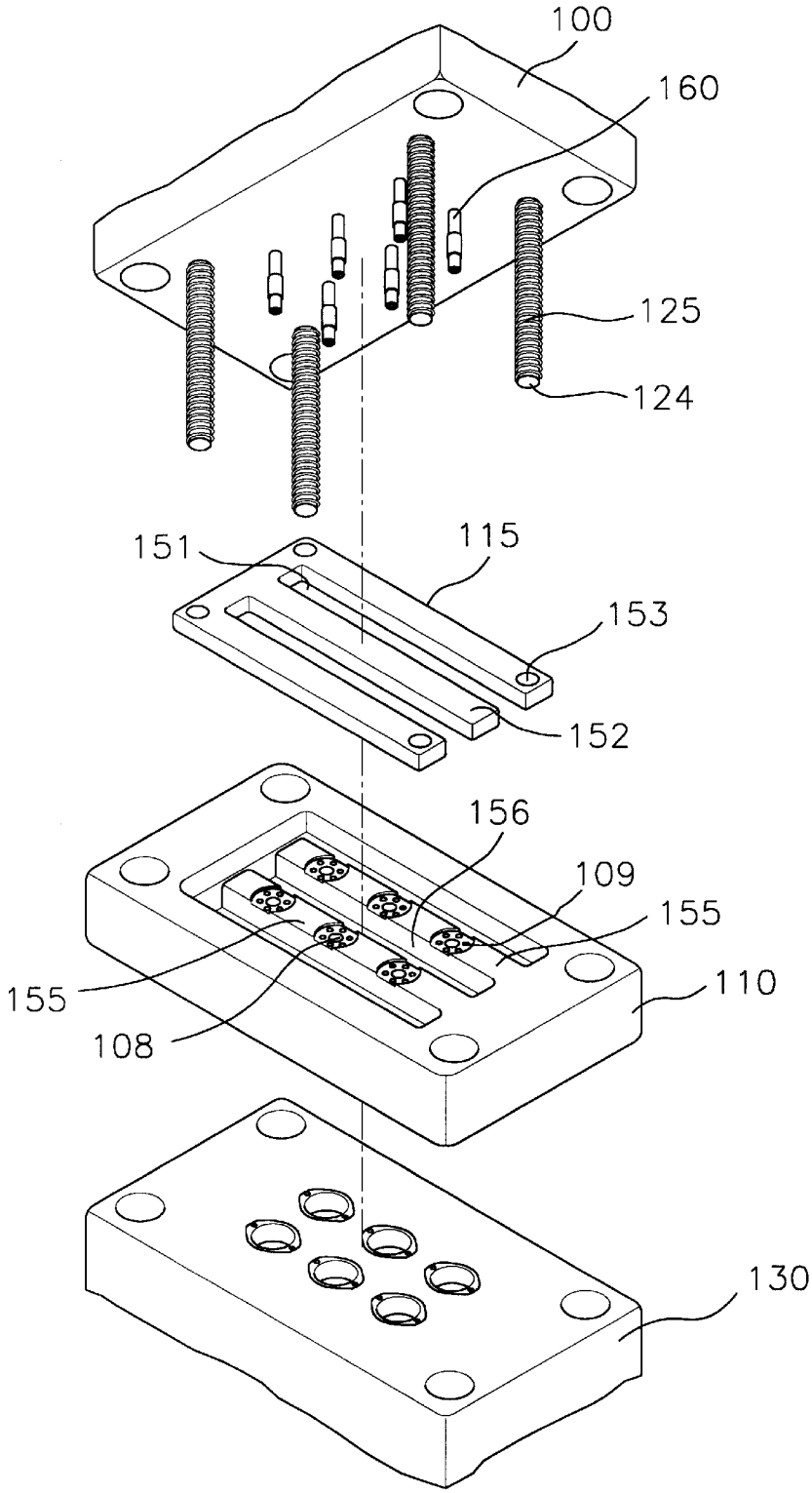
FIG. 5 is an exploded perspective view of an extracting plate and an intermediate plate according to the preferred embodiment of the present invention.

FIG. 5 is an exploded perspective view of an extracting plate and an intermediate plate according to the present invention.

As shown in FIG. 5, the extracting plate 115 has an extension part 152 longitudinally elongated in a central portion, and both opening parts 151 formed at both ends of the extension part 152.

Also, the extracting plate 115 has holes 153 at the corners thereof, and is supported by rods 124 penetrating the holes 153 respectively and springs 125 wound around the rods 124 respectively.

A receiving part 156 which receives the extension part 152 of the extracting plate 115 and both protruding parts 155 which are inserted in both opening parts 151 of said extracting plate 115 are formed in an opposite portion of the intermediate die plate 110 facing the extracting plate 115. A first mold 120 for die casting a rotor is mounted in an opposite portion of the intermediate die plate 110 facing the movable die plate 130.

Six-bores 108 in which six-sizing bars 160 pass through respectively are formed on both protruding parts 155, and a number of molten metal passages 109 are formed on a periphery of each bore 108.

Figure 6:
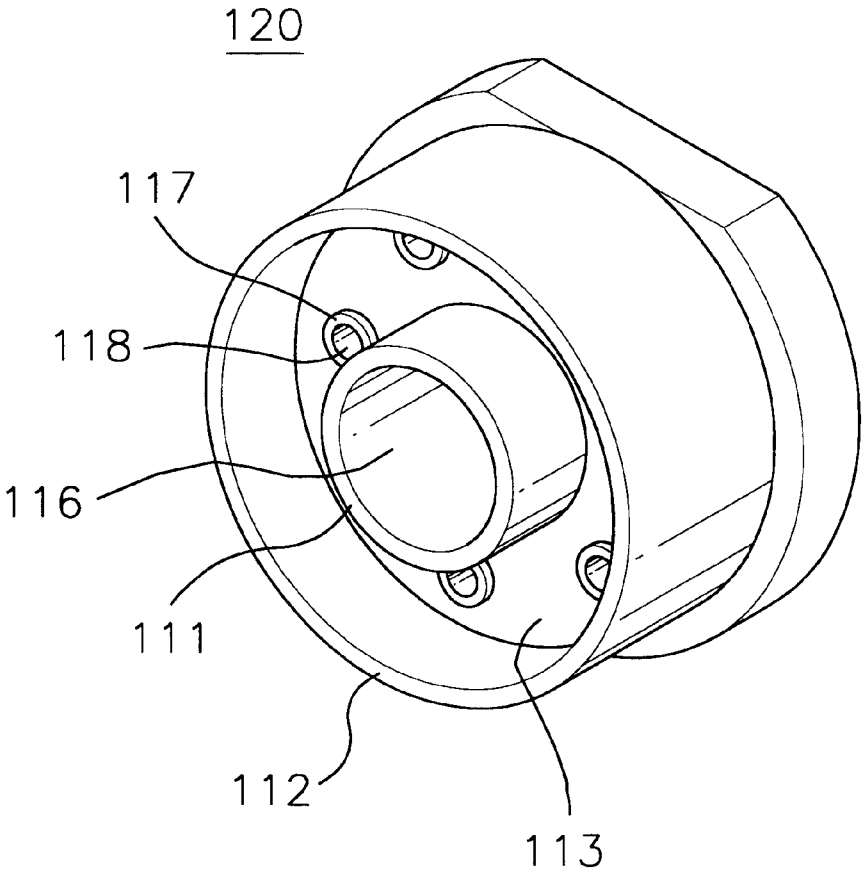
FIG. 6 is a perspective view of a first mold according to the preferred embodiment of the present invention.

FIG. 6 is a perspective view of a first mold according to the present invention.

As shown in FIG. 6, the first mold 120 has an annular inner wall 111 and an annular outer wall 112 projected against an opposite surface of the intermediate die plate 110 facing the movable die plate 130 for insertion into the movable die plate 130 inside at a predetermined depth C. An annular first cavity 113 is formed between said annular inner wall 111 and said annular outer wall 112, and a plurality of sprues 118 extend from an upper surface of the first mold 120 to the first cavity 113. A plurality of gates 117 protrude from a bottom portion of the annular first cavity 113.

Figure 7:
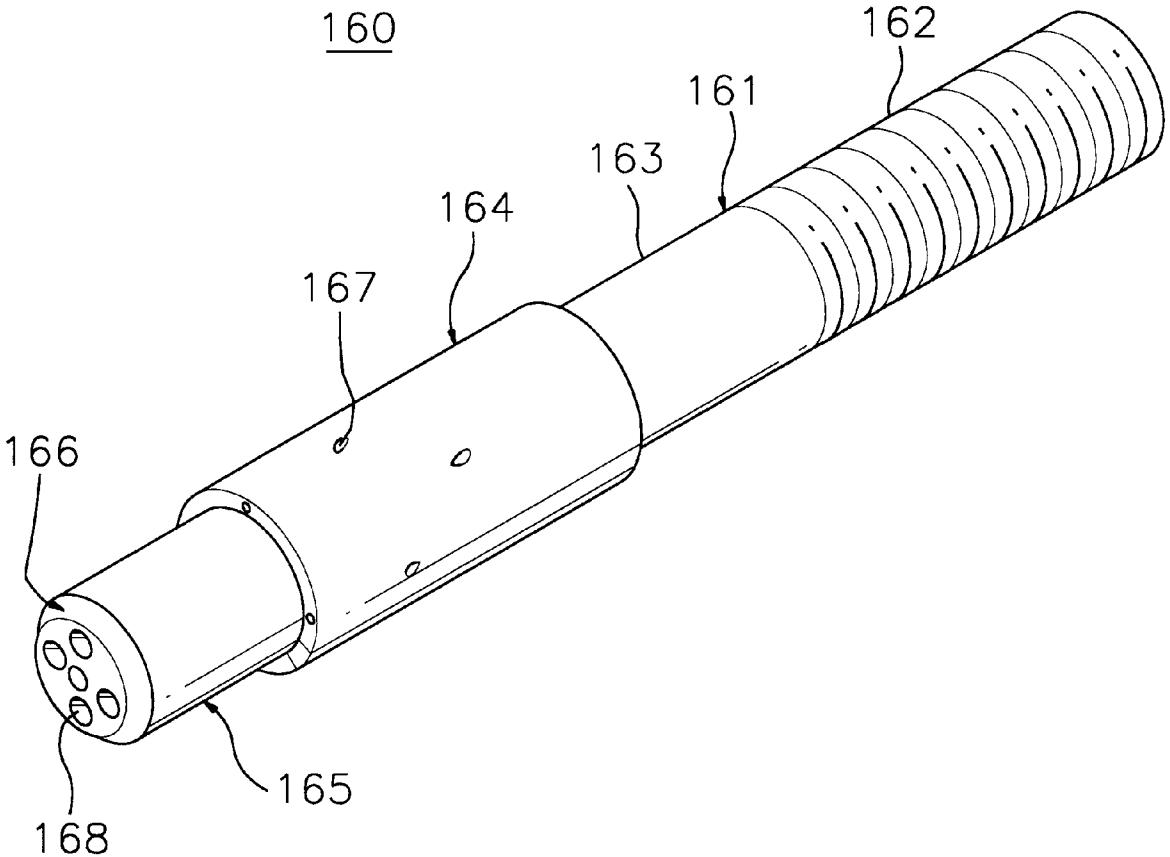
FIG. 7 is a perspective view of a sizing bar according to the preferred embodiment of the present invention.

FIG. 7 is a perspective view of a sizing bar according to the present invention.

As shown in FIG. 7, the sizing bar 160 has a first cylindrical portion 161 with thread portion 162 and non-thread portion 163, a second cylindrical portion 164 having a greater diameter than that of said first cylindrical portion 161, a third cylindrical portion 165 having a same diameter with said first cylindrical portion 161, and a tapered portion 166.

The second cylindrical portion 164 has a plurality of spraying holes 167 for spraying high pressure water, and the tapered portion 166 has a plurality of spraying holes 168 at an end portion thereof.

The thread portion 162 of the first cylindrical portion 161 is mounted in the stationary die plate 100 by a nut 170, and the non-thread portion 163 is inserted in the bore 106 of the insert 104.

Hereinafter, the operation of the die casting apparatus according to the present invention will be described.

Figure 8:
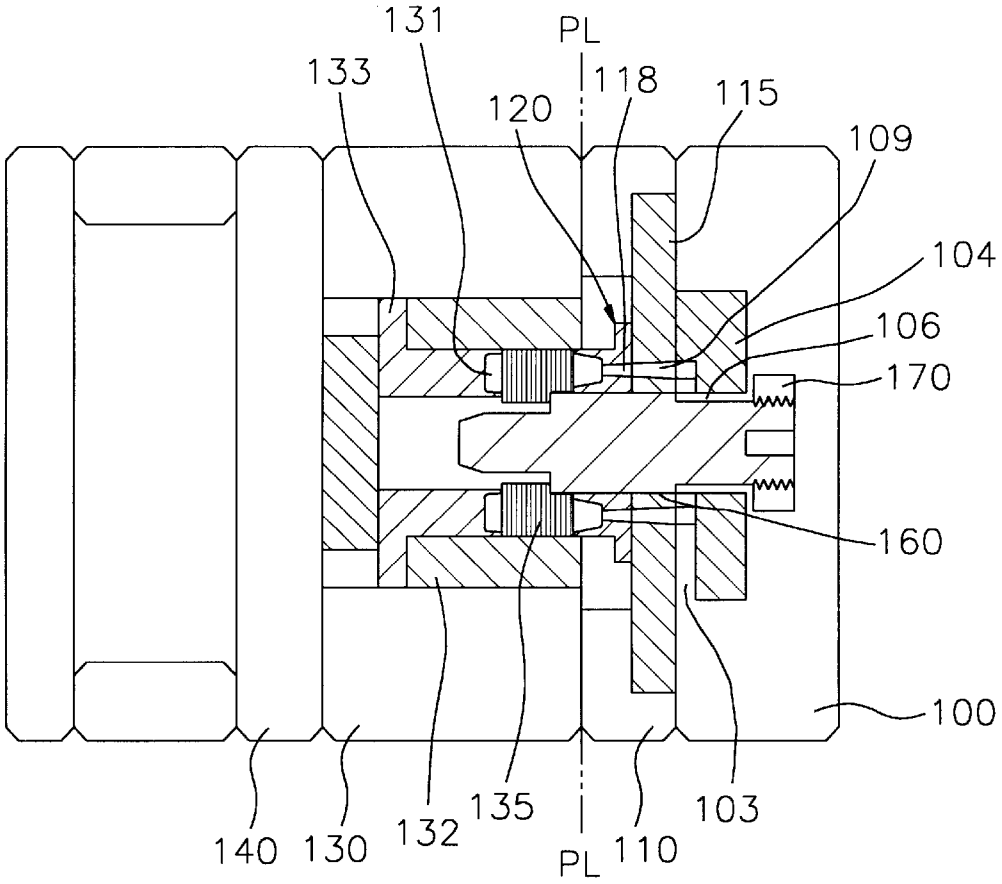
FIG. 8 is a sectional view partially showing one of sleeves and a preform received therein, after the combination of the die casting apparatus shown in FIG. 4.

FIG. 8 is a sectional view partially showing one of sleeves and a preform received therein, after the combination of the die casting apparatus according to the present invention.

As shown in FIG. 8, when the operator inserts the preform 135 in the sleeve 132 and operates the die casting apparatus, the movable die plate 130 and the base die plate 140 horizontally move toward the intermediate die plate 110 by the actuator. Then, the annular inner wall 111 and the annular outer wall 112 of the first mold 120 are received in the sleeve 132 of the movable die plate 110.

The intermediate die plate 110 horizontally moves into the stationary die plate 100 with the movable die plate 130, while receiving the extracting plate 115. The sizing bar 160 is horizontally inserted in the central bore 136 of the preform 135, with a reciprocal motion and a turning motion through the first spaced portion A and the second spaced portion B.

Therefore, the two spaced portions A, B absorb a great load applied to the sizing bar 160, which prevents the sizing bar 160 from breaking.

The sizing bar 160 inserted in the central bore of the preform 135 prevents an inner diameter of the preform 135 from being deformed by the molten metal of high temperature and high pressure.

If the movable die plate 130, the intermediate die plate 110 and the stationary die plate 100 are combined, the molten metal flows into a plurality of sprues 118 through a plurality of the passages 109 formed on the protruding part 155. The sprues 118 inject the molten metal of high pressure into the first cavity 113 through the gates of the sprues 118, and the molten metal flows into the second cavity 131 through the openings of the preform 135.

The molten metal filled between the first mold 120 and the second mold 133 is cooled through cooling water flowing in die plates.

If the die casting is completed, the extracting plate 110, the intermediate die plate 110, the movable die plate 130, and the base die plate 140 are separated respectively.

When the extracting plate 115 is separated from the intermediate die plate 110, the extension part 152 of the extracting plate 115 is suspended and extracts the metal scrap from the intermediate die plate 110.

The metal scrap is formed during cooling of the molten metal in the main passage 103, passages 109, and sprues 118.

The die cast rotor is ejected from the movable die plate 130 through the actuator's operation and is moved into a collecting chamber (not shown) for the rotor.

Figure 9:
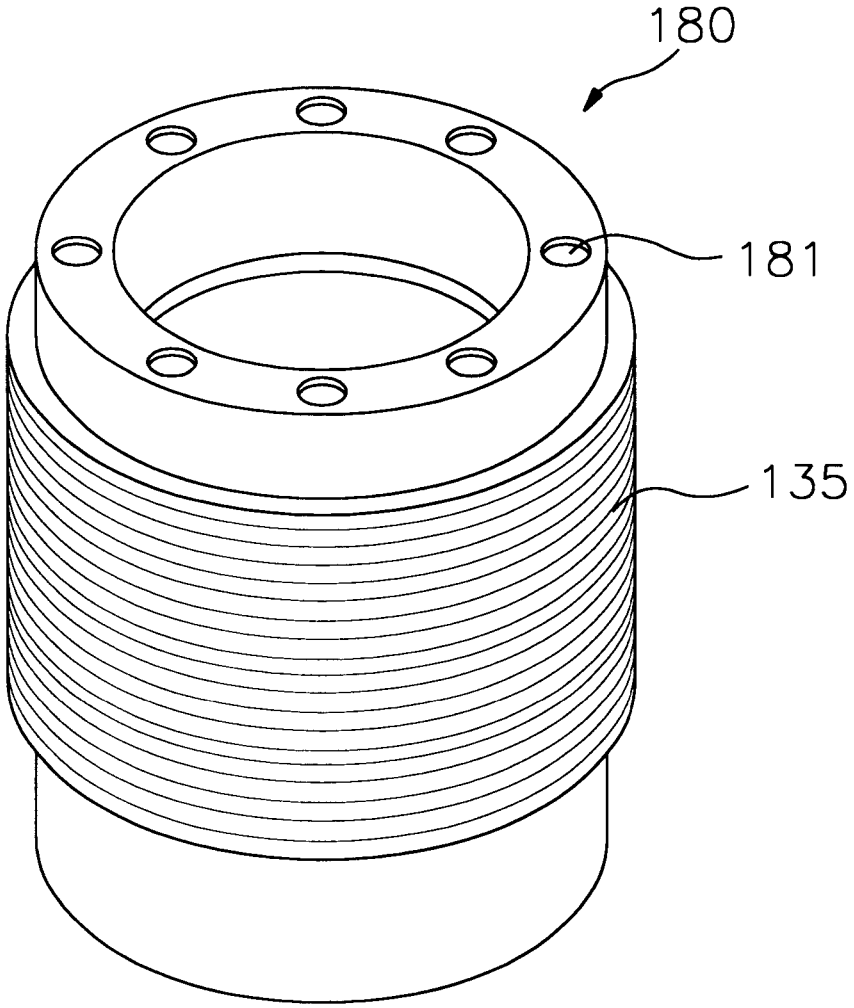
FIG. 9 is a perspective view of a die cast rotor by the die casting apparatus shown in FIG. 8.

FIG. 9 is a perspective view of a die cast rotor by the die casting apparatus according to the present invention.

As shown in FIG. 9, when cooling the molten metal, a plurality of recesses 181 are formed on the upper surface of the die cast rotor 180 by the protruded gates of the sprues 118, and thus an additional reworking process is not required.

After the die plates are separated entirely, the sizing bars or locators 160 inject high pressure water through the spraying holes 167, 168 to clean the extracting plate 115 and the dieplates.

Thus, the overall die casting process using the die casting apparatus according to the present invention is finished.

According to above-mentioned die casting apparatus and method, the sizing bar 160 uniformly maintains the inner diameter's concentricity of the die cast rotor 180, and the first mold 120 prevents the molten metal from leaking into the upper periphery of the preform 135.

Therefore, the die cast rotors do not require reworking processes such as broaching operations and turning operations produce in large quantities, thereby greatly reducing working time and the manufacturing cost of the rotors.

While this invention has been particularly shown and described with reference to particular embodiments thereof, it will be understood by those skilled in the art that various changes in form and details may be effected therein without departing from the spirit and scope of the invention as defined by the appended claims.

What is claimed is:

1. A die casting apparatus for a rotor comprising a stationary die plate in which an insert having a main passage of molten metal and a plurality of bores is mounted, an intermediate die plate in which a plurality of first molds are mounted and for closing off one end of the stationary die plate, a movable die plate in which a plurality of sleeves receiving laminated core members and a plurality of second molds are mounted, the movable die plate being axially separable in abutment with the intermediate die plate, and an extracting plate located axially movably between the stationary die plate and the intermediate die plate and for extracting metal scrap after die casting, being characterized in that:

a plurality of locators which are fixed into bores formed on the insert of the stationary die plate and inserted inside each laminated core member are provided so as to prevent an inner diameter of the laminated core member from being deformed, and said first mold includes an annular inner wall and an annular outer wall projected against an opposite surface of the intermediate die plate facing the movable die plate for inserting the walls into the sleeve;

an annular first cavity formed between the annular inner wall and the annular outer wall;

a plurality of sprues penetrated from an upper surface of the first mold to the first cavity; and a plurality of gates extended from the sprues and protruded from a bottom portion of the annular first cavity.

2. The die casting apparatus for a rotor according to claim 1, wherein said laminated core member received in the sleeve is placed off from an opposite surface of the movable die plate facing said intermediate die plate.

3. The die casting apparatus for a rotor according to claim 1, wherein each said locator of said plurality of locators includes:

a first cylindrical portion which has thread portion and non-thread portion and is fixed into bores formed on the insert of the stationary die plate;

a second cylindrical portion which has a greater diameter than that of the first cylindrical portion, has a plurality of spraying holes for spraying high pressure water and is inserted into the first mold of the intermediate die plate;

a third cylindrical portion which has a same diameter as that of the first cylindrical portion and is inserted into the laminated core member of the movable die plate; and a tapered portion which is formed at one peripheral end of the third cylindrical portion and has a plurality of spraying holes formed at one end portion thereof.

4. The die casting apparatus for a rotor according to claim 3, wherein a first spaced portion is formed between the plurality of locators and the insert so that each said locator can reciprocate in the bore of said insert by a scope of said first spaced portion, and a second spaced portion is formed between each said locator and the bore of said insert so that each said locator can swivel about the nut by the scope of said second spaced portion.

5. The die casting apparatus for a rotor according to claim 1, wherein said extracting plate includes:

a plurality of extension parts longitudinally elongated parallel with each other; and a plurality of opening parts formed respectively between the extension parts adjacent to each other.

6. The die casting apparatus for a rotor according to claim 5, wherein said intermediate die plate includes:

a receiving part which receives the extension parts of the extracting plate; and a plurality of protruding parts which are respectively inserted in each opening part of the extracting plate.

7. The die casting apparatus for a rotor according to claim 6, wherein a plurality of bores into which each said locator of said plurality of locators is inserted are formed on each protruding part of the intermediate die plate, and a plurality of passages in which the molten metal flows are formed on a periphery of each bore.

8. A die casting apparatus for a rotor comprising a stationary die plate in which an insert having a main passage of molten metal and a plurality of bores is mounted, an intermediate die plate in which a plurality of first molds are mounted and for closing off one end of the stationary die plate, a movable die plate in which a plurality of sleeves receiving laminated core members and a plurality of second molds are mounted, the movable die plate being axially separable in abutment with the intermediate die plate, and an extracting plate located axially movably between the stationary die plate and the intermediate die plate and for extracting metal scrap after die casting, being characterized in that:

a plurality of locators which are fixed into bores formed on the insert of the stationary die plate and inserted inside each laminated core member are provided so as to prevent an inner diameter of the laminated core member from being deformed, said first mold includes an annular inner wall and an annular outer wall projected against an opposite surface of the intermediate die plate facing said movable die plate for inserting said walls into the sleeve, an annular first cavity formed between said annular inner wall and said annular outer wall, a plurality of sprues penetrated from an upper surface of the first mold to the first cavity, and a plurality of gates extended from said sprues and protruded from a bottom portion of the annular first cavity, said extracting plate includes a plurality of extension parts longitudinally elongated parallel with each other and a plurality of opening parts formed respectively between the extension parts adjacent to each other, said intermediate die plate includes a receiving part which receives the extension parts of the extracting plate and a plurality of protruding parts which are respectively inserted in each opening part of the extracting plate, and said locator includes a first cylindrical portion which has thread portion and non-thread portion and is fixed into bores formed on the insert of the stationary die plate, a second cylindrical portion which has a greater diameter than that of the first cylindrical portion, has a plurality of spraying holes for spraying high pressure water and is inserted into the first mold of the intermediate die plate, a third cylindrical portion which has a same diameter as that of the first cylindrical portion and is inserted into the laminated core member of the movable die plate, and a tapered portion which is formed at one peripheral end of the third cylindrical portion and has a plurality of spraying holes formed at one end portion thereof.

* * * * *